United States Patent [19]

Berger

[11] Patent Number: 4,729,808

[45] Date of Patent: Mar. 8, 1988

[54] INK RESERVOIR HAVING CONTINUOUS RANDOM SLIVER WITH STRETCH YARN

[75] Inventor: Richard M. Berger, Midlothiam, Va.

[73] Assignee: American Filtrona Corporation, Richmond, Va.

[21] Appl. No.: 852,241

[22] Filed: Apr. 15, 1986

[51] Int. Cl.[4] ..... D04H 1/54

[52] U.S. Cl. ..... 156/180; 401/198

[58] Field of Search ..... 401/196, 198, 199, 265, 401/292; 156/180

[56] References Cited

U.S. PATENT DOCUMENTS

| | | | |
|---|---|---|---|
| 2,713,176 | 7/1955 | Rosenthal | 401/199 |
| 3,094,736 | 6/1963 | Bunzl et al. | 15/563 |
| 3,095,343 | 6/1963 | Berger | 156/180 |
| 3,111,702 | 11/1963 | Berger | 15/563 |
| 3,190,294 | 6/1965 | Dunlap | 401/198 |
| 3,467,564 | 9/1969 | Dougherty et al. | 401/199 X |
| 3,638,410 | 2/1972 | Scherzberg et al. | 57/34 HS |
| 3,747,318 | 7/1973 | Cochran | 57/157 TS |
| 3,774,388 | 11/1973 | Berger, Jr. | 57/157 TS |
| 3,938,314 | 2/1976 | Trammell | 57/157 TS |
| 3,987,614 | 10/1976 | Cardinal et al. | 57/140 BY |
| 4,286,005 | 8/1981 | Berger | 401/198 X |
| 4,395,871 | 8/1983 | Smid et al. | 57/286 |

FOREIGN PATENT DOCUMENTS

| | | | |
|---|---|---|---|
| 1298908 | 7/1969 | Fed. Rep. of Germany | 401/198 |
| 2350970 | 10/1974 | France | 401/199 |
| 30197 | 7/1981 | Japan | 401/199 |
| 609617 | 3/1979 | Switzerland | 401/199 |
| 2036115 | 6/1980 | United Kingdom | 156/180 |

*Primary Examiner*—Dennis L. Taylor

*Attorney, Agent, or Firm*—Holman & Stern

[57] ABSTRACT

An apparatus for producing an ink reservoir material, the reservoir material itself, and a method for making the ink reservoir material, include use of false twist stretch yarn. The yarn is used together with a steam die heater to cause crimping of a yarn bundle, so as to tangle, forming a relatively strong, relatively stable fibrous body usable as an ink reservoir material having good ink-holding properties and to prevent leakers. The ink reservoir can be used with a film overwrap or extruded coating layer. An ink pen uses the ink reservoir material.

8 Claims, 7 Drawing Figures

INK RESERVOIR HAVING CONTINUOUS RANDOM SLIVER WITH STRETCH YARN

BACKGROUND OF THE INVENTION

This invention relates to an apparatus and a process for producing ink reservoir elements for use in marking or writing instruments, and to the ink reservoir element itself.

Ink reservoir elements for use in marking and writing instruments have conventionally been formed of a fibrous bundle compacted together into a rod-shaped unit having longitudinal capillary passageways which extend therethrough between the fibers and which serve to hold the ink and release it at the required controlled rate. For a number of years, the fibrous material generally employed was cellulose acetate fibers, which could readily be heatbonded together with suitable plasticizers into a unitary body, and which were compatible with all of the ink formulations then in use. In recent years, however, ink formulations became more sophisticated so that the writing instruments did not need to be capped to prevent the ink from evaporating. Such new ink formulations required formic acid, which was not compatible with cellulose acetate. For this reason, various thermoplastic fibers and, in particular, polyester fibers, had to be used in place of the cellulose acetate fibers for producing the ink reservoir elements.

Efforts to make polyester fibers into a unitary ink reservoir body have included use of adhesives to bond polyester fibers together, and have also included use of film-overwrapped polyester fiber ink reservoir elements.

Efforts made to heat-bond the polyester fibers to each other without any additive adhesive have not met with much success. Because of the narrow softening point of polyester, it has not been possible to heat-bond drawn polyester fibers such as tow. Undrawn polyester fibers could be heat-bonded together, but produced an unusable product because of shrinkage during processing and lack of stability in the presence of inks at the temperature required for storage of writing instruments. Consequently, polyester fiber ink reservoir elements have heretofore been commercially produced in the form of an unbonded bundle of fibers compacted and held together in a rod-shaped unit by means of a porous film overwrap, and generally including a small diameter plastic "breather" tube disposed between the fibrous bundle and the overwrap and serving as an air release passage. Sometimes, the design of the writing instrument barrel precludes the necessity of a separate "breather" tube.

The film-overwrapped polyester fiber ink reservoir elements, when made with parallel continuous-filament fibers, have had adequate ink holding capacity and ink release properties for use with certain types of marking or writing instruments, for element, those employing fiber tips. However, they have not been successful with the more recent roller marker type of writing instrument, due to the fact that the roller markers require a faster ink release than the conventional fiber tips. Efforts to lower the fiber density and/or change the fiber size to increase the ink release have had limited success because the release is not uniform from start to finish. Also, lowering the fiber density has been found to reduce the ink holding capacity of the reservoir. Forming the reservoir from staple fibers randomly laid, rather than from continuous-filament parallel fibers, has been found to increase the ink release properties of short-length reservoirs, but at the longer lengths required for adequate ink holding capacity, this construction lacks the capillarity to function. Thus, it has not previously been possible to form a polyester fiber ink reservoir element having the proper combination of ink holding capacity and ink release properties satisfactory for use in the roller marker type of writing instrument.

U.S. Pat. No. 4,286,005 issued to Berger relates to an ink reservoir element useful with various types of marking or writing instruments, including roller markers. The ink reservoir element has a combination of ink holding capacity and ink release properties for use with such roller markers. The element is formed of a coherent sheet of flexible thermoplastic fibrous material composed of an interconnecting network of randomly arranged, highly dispersed, continuous-filament junctions. The embossed sheet is formed or compacted and bonded into a dimensionally stable rod-shaped body whose longitudinal axis extends parallel to the embossed grooves. The ink reservoir element is provided with at least one longitudinal peripheral slot extending continuously the entire length of its body and serving as an air release passage if a "breather" passage is required for the particular barrel design. Such ink reservoir construction is compatible with all inks presently being employed and exhibits the proper combination of ink holding capacity and ink release properties so as to render it suitable for use with various types of writing instruments, including roller markers and plastic nibs. This reservoir element requires the use of relatively expensive material, having a complex shape, and has not found commercial acceptance for this reason. This product is not known to prevent pen "leakers".

U.S. Pat. No. 3,094,736 to Bunzl et al teaches a marking device having as the adsorbent body thereof a tow or tow segment comprising continuous filaments randomly oriented primarily in a longitudinal dimension and bonded at a plurality of spaced locations by a plasticizer for such filaments. An impermeable overwrap for such body is used to give rigidity to the body and serve as a handling casing. Filamentary tow was with its filament randomly oriented primarily in a longitudinal direction, and bonded at a plurality of spaced locations by a plasticizer for the filaments. The term "filamentary tow" is defined in this patent, and such continuous filamentary tows are also known in U.S. Pat. Nos. 3,095,343 and 3,111,702. These tows usually comprise at least 50% cellulose acetate fibers. Such tow bodies, bound with plasticizers, provide rigidity.

U.S. Pat. No. 3,111,702 relates to products formed from continuous filamentary tows and also shows in FIG. 2 of the patent an apparatus for handling and steam-treating a tow; this patent is expressly incorporated by reference herein. This reference discusses forming a continuous body of fibers randomly oriented primarily in a longitudinal direction. The phrase, "randomly oriented primarily in a longitudinal direction" is intended to describe the condition of a body of fibers which are, as a whole, longitudinally aligned and which are, in the aggregate, in a parallel orientation, but which have short portions running more or less at random in non-parallel diverging and converging directions. This patent teaches bonding, tensioning and impregnating a raw tow into a plasticizer-impregnated layer of continuous uncrimped filaments, and then curing the continuous filamentary tow simultaneously with, or immediately after, gathering of such impregnated layer into a final raw shape. Apparatus is shown for handling such raw tow. The raw tow is taken from a supply bale through a device having jets to separate the tow, and a plasticizing device adds plasticizer to the fibers. The fibers are simultaneously gathered together and heated, thereby comprising a curing station.

Ink reservoir elements made by the prior art inventions are not compatible with some of the newer ink formulas, which have been changed from the prior art ink formulas in a manner which makes them incompatible with acetate. The use of film-wrapped ink reservoir elements binding polyester tow, having fibers which are substantially entirely parallel to one another, was made to attempt to overcome the deficiency of prior acetate fiber ink reservoir elements, so as to make the film-wrapped elements useable with such inks. With the introduction of the roller marker, a wetter system was required than is required with the conventional nib system. Two problems occured with such reservoir elements made from tow; (1) in order to achieve the wet system required for the roller markers, the low density polyester tow reservoir elements formed a very soft "rod" which gave difficulty in automatic handling equipment; and (2) these units held the ink so loosely that when they were dropped, "leakers" in these pens occured. Such "leakers" are tested for by dropping pens point first onto a hard surface. Should ink leak or spurt out, the pen is judged to be a "leaker". Such "leakers" are highly undesirable.

To attempt to overcome such pen leakers, polyester sliver having random fibers was used to attempt to hold the ink better at lower densities. These sliver-type polyester elements still had problems: (1) they still did not overcome the softness problem; and (2) such sliver is not uniform and therefore weights can vary excessively making it difficult to control ink flow to the roller marker.

The present invention relates to ink reservoirs using as a raw material stretch yarn, often referred to as "false twist stretch yarn". A number of patents are known relating to such "false twist" stretch material. Such material has unusual properties including the abiltity to stretch and curl or twist.

Such patents include for example, U.S. Pat. No. 3,747,318 relating to false-twist texturing yarn with a torque jet; U.S. Pat. No. 3,774,388 to a method for producing synthetic torque yarns; U.S. Pat. No. 4,395,871 to a process for the manufacture of twistless or substantially twistless yarn; U.S. Pat. No. 3,987,614 to a voluminous filament yarn having three-dimensionally curled filaments without loops; U.S. Pat. No. 3,638,410 teaching textured filaments and using "den" terminology and other terminology peculiar to this art; and U.S. Pat. No. 3,938,314 showing a false-twist texturing process using hollow friction twist tubes and discussing "denier" count of the yarn to be crimped as well as other terminology used in this art.

SUMMARY OF THE INVENTION

Accordingly, it is an object of the present invention to make a continuous filament sliver with uniform weight and with good ink holding properties.

It is another object of the present invention to make a firm ink reservoir element which is readily handled on automatic processing equipment.

It is still another object of the present invention to use a sliver having sufficient bulk at a low density to make a firm ink reservoir element.

It is a further object of the present invention to use low density sliver having sufficient randomness (non-parallel fibers) to hold ink adequately to prevent leaks when the pen is dropped.

It is still another object of the present invention to form an ink reservoir structure strong enough so that it can be fed through an extruder die for film coating.

Parallel stretch yarn or other crimped yarn which is heat sensitive is combined and passed, countercurrently to the direction of yarn travel, into the entrance of a forming die together with a hot gas or steam. The hot gas causes these fibers to shrink and entangle and form a stable sliver. This sliver can then be film-wrapped conventionally and/or passed through an extruder die where a film of plastic forms a seamless overwrap.

Extrusion coating is used where the advantage is desired of running continuously at high speeds, without stopping to change bobbins in order to supply sufficient film wrap. Also, extrusion coating is used where it is desirable to avoid weak seams which sometimes pop open in high speed processing equipment.

Parallel stretch yarn, or "false twist stretch yarn", is advantageously used in the present invention to make ink reservoirs of a relatively consistent and uniform density, the density being controllable within a range according to the present invention. Since density can be controlled, reservoirs and reservoir material of any desired density within the permissible range can be made, while avoiding the necessity for an excessively high inventory of different raw materials.

An apparatus is used having a plurality of creels for supplying yarn to a yarn guide, a steam head, and nip rolls. The nip rolls supply a cooling head, garnitures, and a cutter head.

The steam injection die, or any other means of providing heat to the fibers, is used to induce curling of the fibers in a highly uniform and controllable manner.

DETAILED DESCRIPTION OF THE INVENTION

Figure 1:
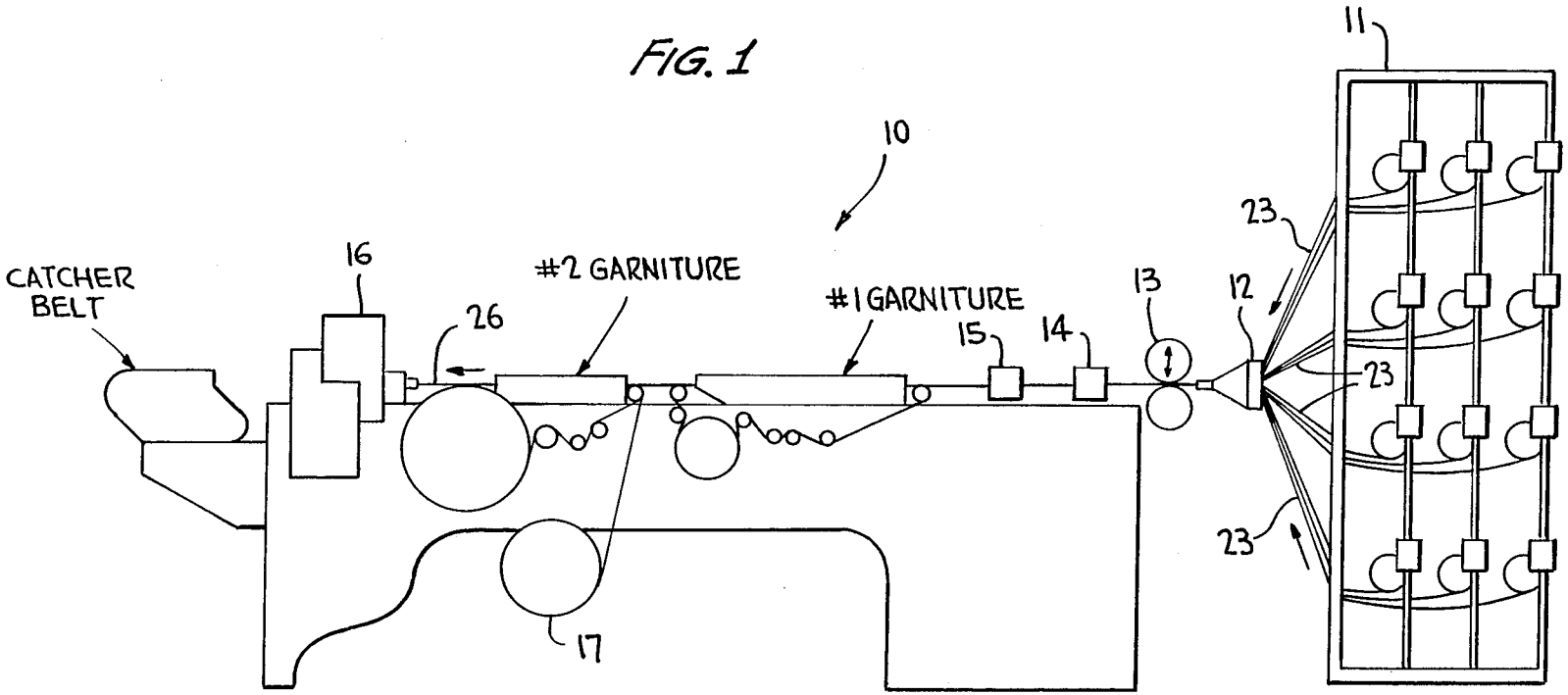
FIG. 1 shows a schematic side elevational view of an apparatus used to make the reservoir material according to the present invention.

FIG. 1 shows an apparatus for forming a fibrous product, in schematic elevational view. The supply of fibers, in this instance stretch yarn, is indicated as creel 11. The creel 11 supplies fibers 23 to a yarn guide 12. The yarn guide 12 supplies the fibers 23 to a pair of nip rolls 13.

Nip rolls 13 supply the fibers to a steam head 14 which in turn supplies the fibers to a cooling head 15.

From the cooling head 15, the fibers are supplied to a first and a second garniture. The first garniture pulls the fibers from the head 15. From the first and second garnitures, the fibers in their processed form 26 are supplied to a cutter head 16. An overwrap supply 17 is seen in FIG. 1 as supplying the second garniture with an overwrap material. This can be omitted if the finished product is not to be used for ink reservoirs; however, for use as ink reservoirs the film overwrap is preferred and advantageously aids in preventing leakage of ink from around the ink reservoir material. Such film overwraps are well-known in the prior art for use with bundled fibers used as ink reservoirs.

The parallel stretch yarn used in the present invention replaces tow, which was previously used. The stretch yarn used in the present invention is processed further by the introduction of heat, as discussed hereunder, to form the final product. Yarns usable in the present invention include stretch yarn, often referred to as false twist stretch yarn. This type of yarn is widely available and is well-known.

Figure 2:
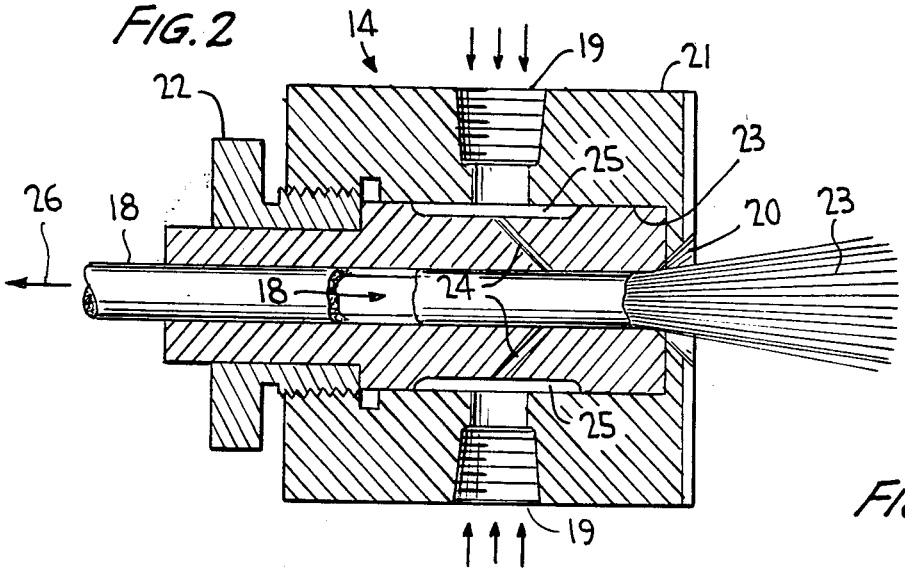
FIG. 2 is a side sectional view of a die head for heat-treating the fibers.

FIG. 2 shows a sectional view of an apparatus forming the steam head 14. Steam head 14 has a block 21 with openings 19 therein. The openings 19 are connected to a supply of steam (not shown), the openings 19 communicating with an interior passage 18 of a member 23. The member 23 has an annular recess 25 to permit steam to flow around the member 23 and enter the passageway 18 via a plurality of generally radially-disposed bores 24. The bores 24 conduct steam to the interior of the passageway 18 where the steam heats the fibers 23. The bores 24 are disposed such that steam enters at an angle to the passageway 18, and countercurrently to the direction of the yarn travel. This countercurrent, non-parallel gas flow, assists, in a minor degree, in tangling of the yarn fibers.

The fibers 23 are received within a funnel-shaped member connected to the block 21, and which communicates with the passageway 18. The fiber bundle is drawn through the passageway 18 by any conventional means of drawing fibers through a treatment station, including pulling of the fibers by a mechanical device such as a belt, rollers, or pneumatically conveying the fibers at a downstream location so as to provide tension in the fibers and draw them through a passageway. Furthermore, the present invention is not limited to such means of drawing fibers through, but may include other, more complex means, including, e.g., pneumatically conveying the fibers 23 into the block 21 itself.

Figure 3:
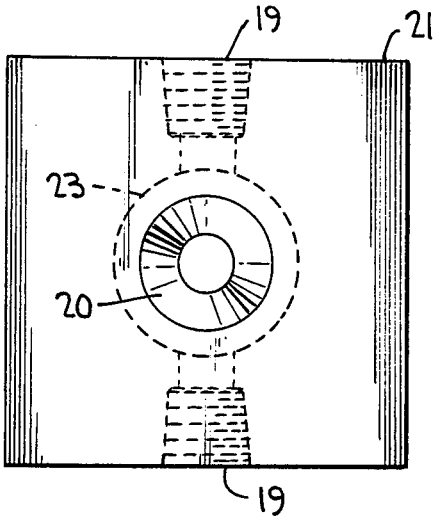
FIG. 3 is a front elevational view of the die head showing the internal openings in dotted outline.

FIG. 3 is a front elevational view as seen from the right of FIG. 2, showing the block 21. The funnel-shaped member 20 is seen in solid outline, and the fullest radial extent of the member 23 is seen in dotted outline. Also, the passageways 19 are seen in dotted outline in FIG. 3.

In operation, fibers 23 are supplied from the creel 11, the creel 11 including a plurality of bobbins for yarn. Automatic splicing is used at the end of the reels, to continuously provide the fibers 23, in the preferred embodiment. The combined fibers 23 entering the head 21, shown in FIG. 2, preferably have a combined weight of approximately 45,000 denier (formed of 150 strands of yarn each strand being 300 denier) going in, and due to the introduction of heat carried by the steam, the fibers (indicated as fiber bundle 26 in FIG. 2) have a weight of approximately 52,500 denier (due to crimping and tangling) going out. Thus, the material going into the block 21 must be conveyed at a higher speed than the material being pulled out, the greater weight being due to tangling and compressing which occurs in the stretch yarn due to the introduction of heat. This compares to tow products, which have weights of either 50,000 denier or 25,000 denier because the raw material is supplied this way.

In one example of the present invention, 150 bobbins of yarn are supplied from the creel 11, each bobbin having yarn of 300 denier, thereby producing a fiber bundle to the nip rolls 13 of 45,000 total denier. By varying the numbers of bobbins, a fiber bundle having any desired denier (in multiples of 300) can be attained. In contrast, tow is supplied only in bales having a range from 25,000 to 50,000 total denier. Therefore, to permit production of ink reservoir material in a range of weights from tow, a large number of bales of tow of different weights would be required. This necessitates keeping of a large inventory of tow bales, each bale having a different denier. With yarn as in the present invention, the inventory need include only a single yarn denier, with total denier varied merely by providing an appropriate number of bobbins of yarn. The number of bobbins in one example of the invention can range from 135 bobbins to 160 bobbins, although there is no actual limit on the number of bobbins which can be used, nor on the denier of yarn on each bobbin.

While steam is used to introduce heat, steam is not necessary to the present invention, but rather the introduction of heat to the fibers at a processing location is necessary to the present invention. This heating is the major cause of curling and tangling of the stretch yarn fibers 23, which do not bond together but remain together due to the above-described tangling. No moisture is required for this process to occur, and therefore other forms of introduction of heat, including passage of dry hot air, microwave heating, radiant heating, and the like could also be used with appropriate handling equipment such as would be known to anyone having skill in the heating arts.

The curling, tangling, or crimping of the stretch yarn due to the introduction of heat is caused by a return of the original crimp introduced to the fibers by the original manufacturer. The manufacturer, in winding of the stretch yarn, actually removes some of the crimp. The step of adding heat to cause the crimp to re-occur in the stretch-yarn fibers is referred to as "blooming", and in the present invention is preferably done within the steam head 14 itself. The velocity differential of fibers entering vs. fibers leaving the apparatus of the present invention in a preferred embodiment is in a range of approximately 10%–30%, which can vary further in speed depending upon the particular fibers used, densities desired, and other variables; however, this speed differential is representative. The preferred approximate range of speeds would be approximately 110%–130% of input relative to output. Thus, in the ideal range, the input speed of fibers 23 would be 10%–30% greater than the output speeds of the processed product. The maximum estimated range of a ratio of input speed to output speed would be from just over 100% to approximately 150%. Due to the processing limitations and the tangling which results, the ratio of input velocity to output velocity could not be exactly 100% or less than 100%.

Mere use of chopped yarn fibers, combined with an adhesive material for adhering the fibers together, would result in a felt-like material having a weight which is relatively non-uniform. The weight and density of such a material is difficult to control in uniformity, and therefore would result in non-uniform ink reservoirs, some of which would be likely to leak, and others of which would have undesirable ink-holding and ink-release properties.

The preferred stretch yarn weight is 150 denier, and two of these can be combined together, e.g. to form a weight of 300 denier. A commercially practical upper limit on the weight of the stretch yarn used in the present invention is approximately 600 denier. The present process has no actual lower limit; however, as a practical commercial lower limit, approximately 75 denier is preferred for reasons of efficiency and production speed. The range preferred for weight of the stretch yarn is approximately 100 denier to approximately 300 denier, with the weight of the stretch yarn being preferably approximately 150 denier. The higher the weight, the better for handling; for uniformity, however, the lower the weight, the better. The preferred range and the preferred weight of 150 denier is chosen in view of these conflicting considerations of handling and uniformity.

In the steam head 14, the fibers bloom and therefore bend in a generally transverse direction to the path of travel of the overall fiber bundle. Even without a film overwrap added at the station 17, the processed fiber product is stable due to the tangling of the fibers. No bonding of the fibers occurs, i.e. the heat does not produce "weld" spots nor is adhesive used. The film wrap, when applied, keeps ink within the reservoir and also serves to provide an additional reinforcement to hold the bundle together. The main use of the film wrap in the ink reservoir, however, is to keep ink within the reservoir, since the ink reservoir fiber bundle is itself stable in the present invention. In some cases, the fibers are wrapped around an air breather tube, depending upon the particular pen in which the ink reservoir is to be used. For pens having an air breather hole, such air breather tube is not necessary.

Figure 4:
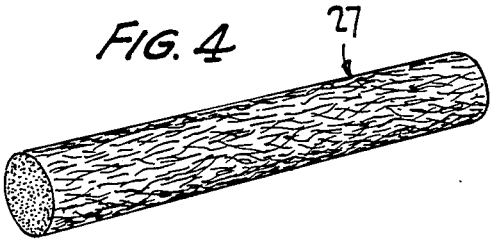
FIG. 4 is a perspective view of a prior art ink reservoir.
Figure 5:
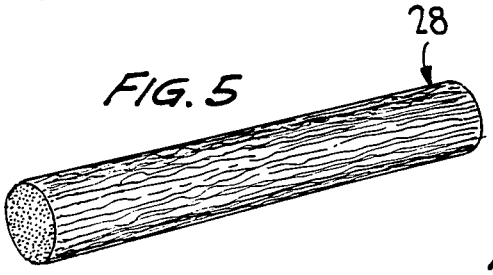
FIG. 5 is a perspective view of another prior art ink reservoir.

FIG. 4 illustrates in an exaggerated manner the orientation of fiber in a prior art "sliver" type of ink reservoir. As seen, a plurality of relatively short fibers are oriented generally longitudinally of a body 27, the individual fibers being generally individually randomly curved. FIG. 5 shows the "tow" type of prior art ink reservoir material. As can be seen, continuous fibers of the body 28 are oriented generally longitudinally. There is little or no tangling of the fibers of the body 28. This figure is also shown in an exaggerated fashion, to indicate the general nature of the fibers and their general orientation relative to one another.

Figure 6:
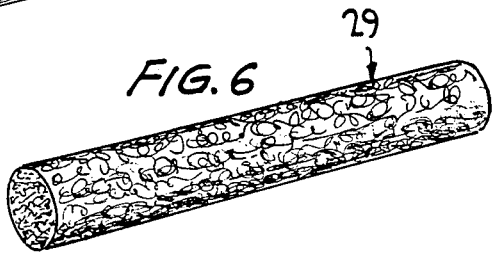
FIG. 6 is a perspective view of a fibrous body, usable as an ink reservoir, according to the present invention.

FIG. 6 is a view of an ink reservoir body 29 formed according to the present invention of stretch yarn. The body 29 has a plurality of tangled fibers having curl and twist. The tangling and the depiction of the fibers is exaggerated somewhat for clarity. None of the FIGS. 4–6 are drawn to scale, but rather are illustrative of the product formed in the two main types of prior art ink reservoirs and in the ink reservoir according to the present invention.

Figure 7:
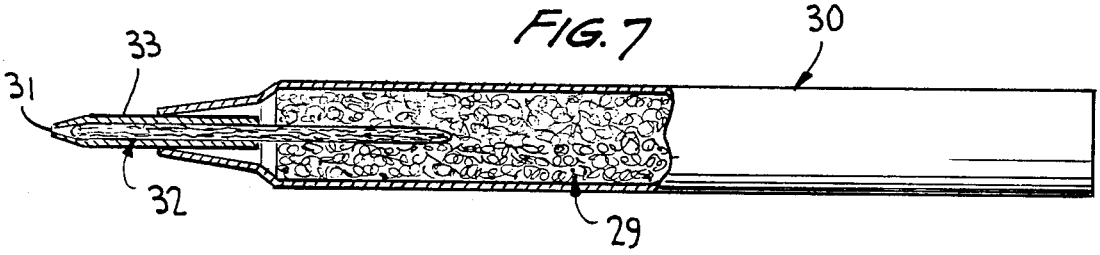
FIG. 7 is a side elevation view partially broken away, of an ink pen with an ink reservoir.

FIG. 7 is a side elevational view, partially broken away to show a structure of an ink pen. The ink pen has a body 30 supporting a hollow tip 33. The tip 33 receives a wick 32, the wick 32 extending through the tip 33 and into an ink reservoir body 29. The tip 33 rotatably supports a roller ball 31 for writing. Such ink pen construction is known in the prior art.

According to the present invention, any stretch yarn can be used which is "heat sensitive", i.e., upon addition of heat to the fibers, the fibers shrink and entangle to form a stable material. The product of the present invention is referred to in the following as "test product #1" and "test product #2". Two prior art materials, well-known and commercially available, are referred to in the following as "Tow Transorb R" and "Sliver Transorb R", and are listed in the following Table I, together with two "test products" formed by the fibrous mass of the present invention. In this Table, cylindrical rods were tested having a "standard" diameter and length. Other lengths of the finished product can be made, as can other diameters. The test samples are generally cylindrical in shape. Other cross-sectional shapes can be used as well, such as square, oval, triangular and the like.

TABLE I

The following data is a comparison of the test products, #1 and #2, with commercially available grades of ink reservoir products of sliver and tow used commercially for ink reservoirs in pens. The commercial grade number is used for the sliver and tow products. The "WT. S.D." is defined as the standard deviation of weight measured from multiple test runs using multiple test samples of each type of product.

| | Size (diameter, mm × length mm) | Weight (grams) | Wt. S.D. (grams) | Hardness (AFC Test) |
|---|---|---|---|---|
| Tow Transorb R | | | | |
| R-9529 | 6.4 × 92 | .700 | .005 | 95 |
| R-9903 | 6.4 × 92 | .629 | .007 | 87 |
| Sliver Transorb R | | | | |
| R-9710 | 6.4 × 92 | .548 | .0369 | 75 |
| R-7508 | 6.4 × 92 | .677 | .0211 | 85 |
| Test Product | | | | |
| #1 | 6.4 × 92 | .668 | .0015 | 138 |
| #2 | 6.4 × 92 | .648 | .0038 | 131 |
| *#3 | 6.4 × 92 | .510 | .0030 | 108 |

*Test Product #3 was composed of 120 ends of 300 denier

The term "AFC Test" hardness as used herein and in the appended claims, is based on the following test. The testing apparatus is a Model 551 micrometer manufactured by Testing Machines, Inc. Mineola, N.Y. The micrometer has a dead weight loading of approximately 2½ pounds with the weight on and exerts a pressure of 7 to 9 pounds per square inch. The size and weight are determined on rods. The micrometer is opened to its stop point of 0.3438 inches. The rod is placed on the lower anvil of the micrometer and the upper anvil is then released. The reading is immediately taken after the anvil has come to rest, with no waiting period. This reading is the final diameter of the rod, as compressed by the weight in inches multiplied by 1000.

The above data indicates that the test product referred to as #1 in the above is considerably harder than the tested conventional sliver and tow products. Also its tested standard deviation in weight among multiple test runs ("Wt. S.D.") is better (lower) than the tested products made from tow and considerably better than the tested products made from sliver. Thus, the products of yarn according to the present invention are much more uniform than those made from tow or sliver commercially available.

The low density polyester tow products were used for roller markers by ink pen manufacturers and these two products made a very soft rod which gave difficulty in automatic handling equipment. Also, these units held ink so loosely that when dropped, leakers in these pens occured. To overcome the pen leakers, the manufacturers of ink pens switched to polyester sliver products having random fibers which generally hold the ink better at lower density. These sliver-type products still did not overcome the softness problem. Also, such sliver is not uniform, and the weights and densities of the final product can vary excessively relative to a desired weight for ink reservoirs, thereby making it difficult to control ink flow to the roller marker. The present product is formed of stretch yarn, has relatively uniform weight, has sufficient bulk, and has a sufficiently low density, to make a firm ink reservoir material which can be handled on automatic equipment. Furthermore, the product of the present invention has sufficient randomness in its fiber orientation, i.e. sufficient non-parallel fibers, to hold the ink adequately to prevent ink loss when the pen is dropped, thus preventing leakers; and the structure of this product is strong enough so that it can be fed through an extruder die if desired, for film coating. Such film coating is optional and not necessary to the present invention. Other processing steps to make the product compatible with any writing implement are also contemplated as being within the scope of the present invention.

The advantages of extrusion coating are that the fiber bundles 23 can be run continuously at higher speed without stopping to change bobbins of film wrap. Thus, extrusion coating can be used to avoid use of film overwrap, and it has the advantage of eliminating the problems of weak seams formed by the film overwrap which sometimes pop open in high speed equipment.

An advantage of using stretch yarn rather than tow, together with the heat treatment of the present invention, is that any desired density of ink reservoir product can be made without requiring an excessively high inventory of different weights of starting materials, since according to the present invention the density can be controlled by controlling the relative speeds of the fibers going into the inventive apparatus and fibers leaving the inventive apparatus. Methods and apparatus for controlling fiber speeds per se are well-known in the filter arts, and in particular the cigarette filter arts, wherein such control of inlet and outlet speeds of fibrous materials is known and used. The product 26 formed according to the present invention can be used for a wick for any application where a wick would be used and is not limited to use as an ink reservoir.

While a preferred embodiment of the present invention has been shown and discussed, it will be understood that the present invention is not limited thereto, but may be otherwise embodied within the scope of the following claims.

What is claimed is:

1. A method of making a fibrous body for use in an ink reservoir, comprising the steps of:

supplying a plurality of fibers of false twist stretch yarn;

gathering said fibers in an unprocessed bundle;

supplying a chamber for passage of said bundle of fibers therethrough;

supplying a means for heating said bundle of fibers;

said means for heating supplying heat to said chamber during passage therethrough of said bundle of fibers;

heating said bundle of fibers by said means for heating;

permitting tangling of said bundle of fibers in said chamber due to application of heat thereto by said means for heating;

drawing said tangled bundle of fibers from said chamber;

cooling said tangled bundle of fibers;

said tangled gathered bundle of fibers upon cooling forming a relatively strong fibrous body.

2. A method as claimed in claim 1, further comprising a step of providing a film overwrap about said fibrous body.

3. A method claimed in claim 1, further compromising a means for shaping said gathered bundles of fibers to form a shaped product.

4. A method as claimed in claim 1, further comprising providing a means for extruding a coating to surround said gathered bundle of fibers, said coating forming a relatively solid membrane about said gathered bundle of fibers.

5. A method as claimed in claim 1, further comprising providing a ratio of a fiber input velocity to an output velocity of yarn from said means for supplying heat of said gathered bundle of fiber, in a range of approximately 1.1:1.3.

6. A method as claimed in claim 5, wherein said ratio is sufficient to cause a final product hardness according to the AFC test in a range of approximately 108–138.

7. A method as claimed in claim 5, wherein said speed ratio is selected so that said gathered bundle of fibers exiting said means for supplying heat has a weight standard deviation of approximately 0.0015.

8. A method as claimed in claim 5, wherein said gathered bundle of fibers at a location downstream from said means for supplying heat, has a weight standard deviation of approximately 0.0038.

* * * * *